US007051971B2

(12) United States Patent
Takeda et al.

(10) Patent No.: US 7,051,971 B2
(45) Date of Patent: May 30, 2006

(54) FEEDING BOBBIN AND METHOD FOR RECYCLING SAID FEEDING BOBBIN

(75) Inventors: Kenichi Takeda, Shinjuku-Ku (JP); Eiichi Kitayama, Shinjuku-Ku (JP); Junichi Hiroi, Shinjuku-Ku (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 10/338,881

(22) Filed: Jan. 9, 2003

(65) Prior Publication Data

US 2003/0155462 A1 Aug. 21, 2003

(30) Foreign Application Priority Data

Jan. 10, 2002 (JP) ..... 2002-003002

(51) Int. Cl.
*B65H 75/24* (2006.01)

(52) U.S. Cl. ..... 242/578.2

(58) Field of Classification Search ..... 242/578, 242/578.2, 608, 608.2, 608.3, 608.4, 608.5, 242/608.6, 608.7, 609–609.4, 610.5, 610.4, 242/611.2

See application file for complete search history.

(56) References Cited

U.S. PATENT DOCUMENTS

| | | | | |
|---|---|---|---|---|
| 1,294,628 | A * | 2/1919 | Davis | 242/608.5 |
| 3,411,734 | A * | 11/1968 | Greenberg et al. | 242/578.2 |
| 3,848,310 | A * | 11/1974 | Steinback | 242/610.5 |
| 4,381,088 | A * | 4/1983 | Bryant | 242/118.7 |
| 4,726,534 | A * | 2/1988 | Chenoweth | 242/609.3 |
| 6,315,235 | B1 * | 11/2001 | Breyer et al. | 242/578.2 |
| 2002/0017588 | A1 * | 2/2002 | Kitayama | 242/608.6 |
| 2002/0066824 | A1 * | 6/2002 | Floyd et al. | 242/609.4 |

FOREIGN PATENT DOCUMENTS

JP 2001-261242 * 9/2001

* cited by examiner

*Primary Examiner*—William A. Rivera
(74) *Attorney, Agent, or Firm*—Oliff & Berridge, PLC

(57) ABSTRACT

A feeding bobbin including a winding shaft including two ends each having a flange detachable mounted thereon, the shaft being common to various feeding bobbins for a thermal transfer printer, wherein the flanges are separated by a width corresponding to the width of a thermal transfer sheet or image receiving sheet to be wound around the winding shaft, and the winding shaft includes a portion for receiving such sheet wound thereon, the portion having a width regulatable by location of a combination of the flanges according to the width of such sheet.

3 Claims, 4 Drawing Sheets

FIG. 2A
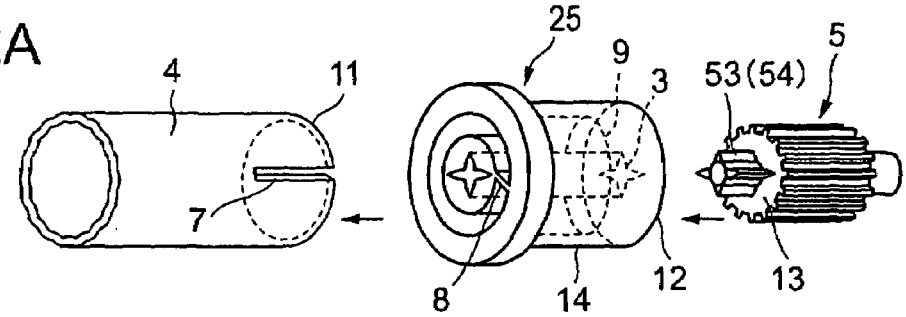
FIG. 2B
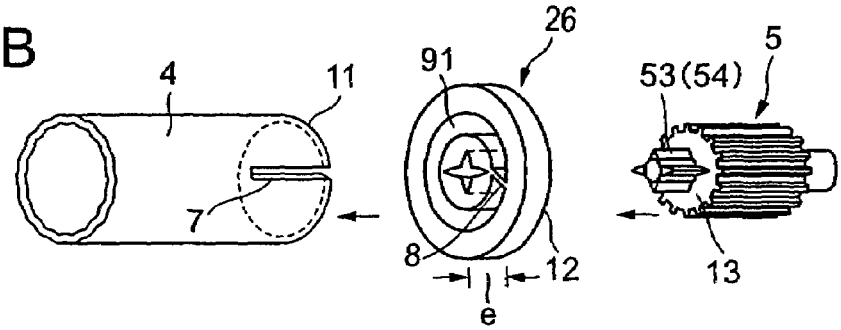
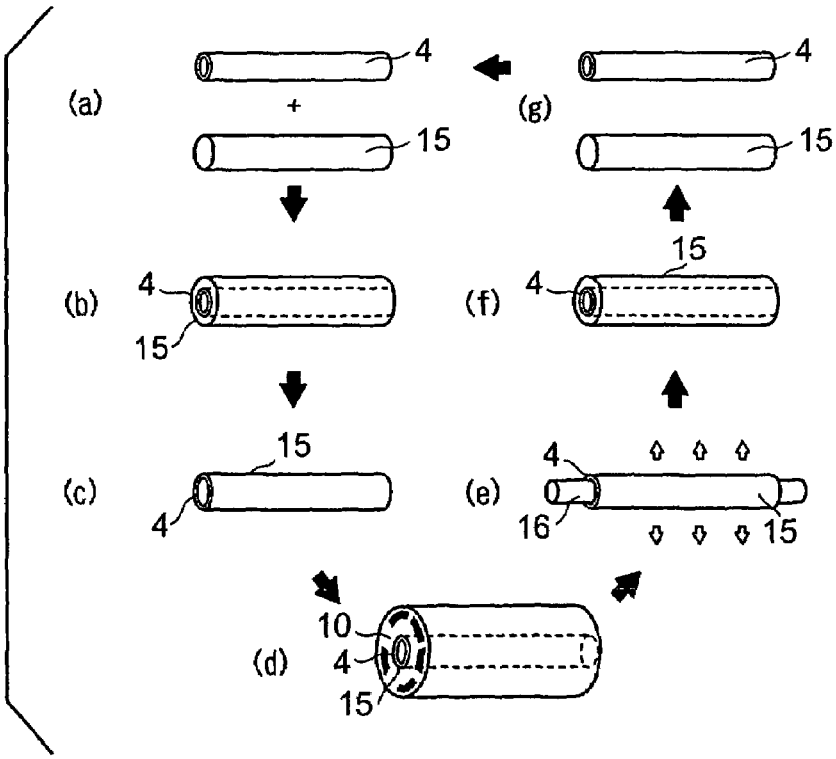
FIG. 3

FEEDING BOBBIN AND METHOD FOR RECYCLING SAID FEEDING BOBBIN

BACKGROUND OF THE INVENTION

1. Field of the Invention

The present invention relates to a feeding bobbin for winding a thermal transfer sheet or an image receiving sheet on which an image is to be formed using the thermal transfer sheet, and a method for repeatedly recycling the feeding bobbin.

2. Prior Art

Various thermal transfer methods have hitherto been known in the art. In these thermal transfer methods, a color transfer layer is formed on a substrate to prepare a thermal transfer sheet. The thermal transfer sheet is put on top of an image receiving sheet, and the assembly is heated in a character, figure, pattern or other image form, for example, by means of a thermal head from the backside of the substrate of the thermal transfer sheet to thermally transfer the color transfer layer onto the surface of the image receiving sheet. The thermal transfer methods are roughly classified according to the construction of the color transfer layer into two methods, i.e., thermal dye sublimation transfer (sublimation-type thermal transfer) and thermal ink transfer (heat-fusion transfer). In the thermal dye sublimation transfer method, a color transfer layer comprising a dye, which is thermally sublimable or transferable, supported by a suitable binder is first formed on a substrate to prepare a thermal transfer sheet. The thermal transfer sheet is put on top of an image receiving sheet, and the assembly is heated from the backside of the thermal transfer sheet to thermally transfer the dye contained in the color transfer layer onto the surface of the image receiving sheet. In this case, the image receiving sheet has on its surface a receptive layer which can be easily colored with a dye. On the other hand, in the thermal ink transfer method, a color transfer layer, which can be easily softened and fused and is transferable upon heating, is first formed on a substrate to prepare a thermal transfer sheet. The thermal transfer sheet is put on top of an image receiving sheet, and the assembly is heated from the backside of the thermal transfer sheet to transfer the color transfer layer onto the surface of the image receiving sheet.

Since the above thermal transfer sheet is continuous, the thermal transfer sheet takes a roll form. In this case, the thermal transfer sheet is generally wound onto a feeding bobbin, and the leading end of the thermal transfer sheet is bonded to and wound onto a wind-up bobbin. In a thermal transfer printer, the thermal transfer sheet is carried from the feeding bobbin to the wind-up bobbin to perform transfer recording on an image receiving sheet.

In a feeding bobbin 1 as shown in FIG. 5, flanges 27, 28, which have an edge guide function for a thermal transfer sheet 10, are provided on a winding shaft 4 so that the thermal transfer sheet 10 can be wound onto the winding shaft 4 in its predetermined place without meandering. The feeding bobbin 1 includes a bearing part 3. A bobbin rotary drive part (not shown) is provided in a thermal transfer printer. The bearing part 3 in the feeding bobbin 1 engages with the rotary drive part, and, upon the rotation of the feeding bobbin 1, the thermal transfer sheet is moved and is carried to the wind-up bobbin side.

In the above-described feeding bobbin, when a thermal transfer sheet having a different width is wound, common practice adopted in the prior art is such that a specialty feeding bobbin corresponding to the width of the thermal transfer sheet is provided, the thermal transfer sheet is wound onto the specialty feeding bobbin, and the specialty bobbin with the thermal transfer sheet wound thereonto is mounted in a thermal transfer printer. Therefore, every time when a thermal transfer sheet having a different size (width) is used, a specialty feeding bobbin for the thermal transfer sheet having a different size (width) should be provided. In this case, further, regarding a small roll winding device for winding the thermal transfer sheet having a different size onto the specialty feeding bobbin for the thermal transfer sheet, the mounting position of an edge guide or the like should be changed to cope with the difference in size (width) of the thermal transfer sheet. This disadvantageously requires time and labor and significantly increases a work burden.

Further, specialty feeding bobbins respectively for thermal transfer sheets different from each other or one another in size (width) should be provided. For this reason, at the present time, when the thermal transfer sheet wound onto the specialty feeding bobbin has once been used up, the feeding bobbin is discarded. The discarded feeding bobbins are in many cases plastic products. Disadvantageously, the disposal of bobbins is not environmentally friendly. The separation and recovery of the bobbin products are cost ineffective. Thus, the prior art technique suffers from many problems. These facts apply to feeding bobbins for winding a continuous thermal transfer sheet, as well as to feeding bobbins for winding a continuous image receiving sheet.

SUMMARY OF THE INVENTION

In order to solve the above problems of the prior art, an object of the present invention is to provide a feeding bobbin in which, in winding a thermal transfer sheet or image receiving sheet having a different size (width), onto the feeding bobbin, work on the side of a small roll winding device is easy, thermal transfer sheets or image receiving sheets different from each other in size (width) can be used in various thermal transfer printers, and the feeding bobbin can be recycled without the necessity of disposal and without causing any trouble, and to provide a method for recycling the feeding bobbin.

The above object can be attained by a feeding bobbin comprising: a winding shaft common to various feeding bobbins for a thermal transfer printer; and flanges mounted detachable respectively on both ends of the winding shaft, said flanges being in a form corresponding to the width of a thermal transfer sheet or image receiving sheet to be wound around the winding shaft, said feeding bobbin having been constructed so that the width of the winding shaft in its portion around which said sheet is wound is regulatable by using a combination of the flanges in a predetermined form corresponding to the width of the sheet with the common winding shaft and, when a thermal transfer sheet or image receiving sheet different in width from a thermal transfer sheet or image receiving sheet which has been previously used, is wound around the common winding shaft, the flanges are replaced with those corresponding to the width of the thermal transfer sheet or image receiving sheet to be wound while using the common winding shaft without replacement.

In a preferred embodiment of the present invention, the winding shaft has a structure comprising a metallic shaft covered with a heat shrinkable plastic and, after the use of the wound thermal transfer sheet or image receiving sheet, the metallic shaft is heated to separate the metallic shaft from the heat shrinkable plastic. According to this construction, in winding the thermal transfer sheet or image receiving sheet around the surface of the winding shaft of the feeding bobbin, the winding shaft per se is less likely to be damaged because the surface of the winding shaft is covered with the heat shrinkable plastic. That is, the durability of the bobbin is so high that the feeding bobbin can be advantageously recycled by an increased number of times. If damage to the heat shrinkable plastic is found after the use of the feeding bobbin, then the heat shrinkable plastic can be easily separated from the winding shaft by heating the winding shaft to deform the heat shrinkable plastic covering the winding shaft.

Preferably, the metallic shaft is formed of a metal selected from the group consisting of aluminum, stainless steel, iron, copper, or titanium which has been used either as such or as a composite of said metals. According to this construction, the durability in recycling of the metallic shaft can be improved.

According to another aspect of the present invention, there is provided a method for recycling a feeding bobbin, comprising the steps of: winding a thermal transfer sheet or image receiving sheet around said winding shaft to prepare a feeding bobbin; using, in a thermal transfer printer, the feeding bobbin with the thermal transfer sheet or image receiving sheet wound thereonto; heating the winding shaft portion of the used feeding bobbin, and separating the heat shrinkable plastic from the metallic shaft; and reusing the separated winding shaft and the flanges to prepare a feeding bobbin.

BRIEF DESCRIPTION OF THE DRAWINGS

FIG. 2A is a schematic diagram illustrating coupling between a winding shaft and a flange and coupling between a flange and a rotary drive shaft in an embodiment of the feeding bobbin according to the present invention;

FIG. 2B is a schematic diagram illustrating coupling between a winding shaft and a flange and coupling between a flange and a rotary drive shaft in another embodiment of the feeding bobbin according to the present invention;

FIG. 3 is a schematic diagram of a feeding bobbin illustrating a winding shaft part of the feeding bobbin according to the present invention;

DETAILED DESCRIPTION OF THE INVENTION

Embodiments of the present invention will be described with reference to the accompanying drawings.

Figure 1A:
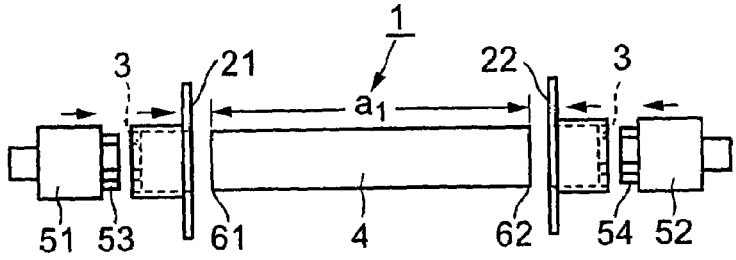
FIG. 1A is a schematic diagram of an embodiment of the feeding bobbin according to the present invention.
Figure 1B:
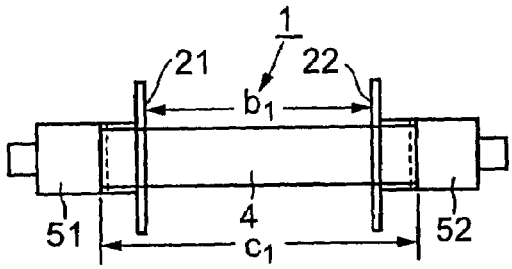
FIG. 1B is a schematic diagram of an embodiment of the feeding bobbin according to the present invention.

FIGS. 1A to 1F show a feeding bobbin 1 which is an embodiment of the present invention. The feeding bobbin 1 is a bobbin for a thermal transfer sheet or image receiving sheet 10 and includes a bobbin winding shaft 4. A detachable flange 23 is provided at one end 61 of the bobbin winding shaft 4, and a detachable flange 24 is provided at the other end 62 of the bobbin winding shaft 4. The flanges 22, 24 each have a bearing part 3. Both ends of the bobbin 1 with the flanges 22,24 mounted thereon are constructed so that rotary drive shafts 51, 52 from a small roll winding device or a thermal transfer printer side engage respectively with the bearing parts 3. The feeding bobbin 1 with the flanges 22,24 is rotated in interlock with the rotation of the rotary drive shafts 51, 52. The bobbin winding shaft 4 has a length of $a_1$, and the flanges 22,24 are in a cap form. FIG. 1A shows the bobbin winding shaft 4, the flanges 21, 22, and the rotary drive shafts 51, 52 which are in a state before coupling to one another. On the other hand, FIG. 1B shows the bobbin winding shaft 4, the cap-shaped flanges 21, 22, and the rotary drive shafts 51, 52 all of which have been integrally coupled to one another.

At the time of coupling of the individual members to one another from the state shown in FIG. 1A, the flange 21 and the rotary drive shaft 51 are moved in a direction indicated by a right arrow in the drawing, and the flange 22 and the rotary drive shaft 52 are moved in a direction indicated by a left arrow in the drawing. One end 61 of the winding shaft 4 is inserted into a hollow part of the cap of the flange 21, and the other end 62 of the winding shaft 4 is inserted into a hollow part of the cap of the flange 22. Further, a contact part 53 of the rotary drive shaft 51 is inserted into the bearing part 3 of the flange 21, and a contact part 54 of the rotary drive shaft 52 is inserted into the bearing part 3 of the flange 22. Thus, as shown in FIG. 1B, all of the bobbin winding shaft 4, the cap-shaped flanges 21, 22, and the rotary drive shafts 51, 52 are coupled to one another. In FIG. 1B, the flanges 21, 22 are coupled to the bobbin winding shaft 4 in a distance $c_1$ between the rotary drive shaft 51 and the rotary drive shaft 52. The distance represented by $b_1$ is the distance between the flange 21 and the flange 22.

Figure 1C:
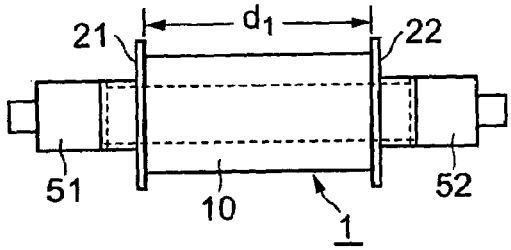
FIG. 1C is a schematic diagram of an embodiment of the feeding bobbin according to the present invention.

Next, a thermal transfer sheet or image receiving sheet 10 having a width of $d_1$ is wound around the winding shaft 4 of the feeding bobbin 1 in the state shown in FIG. 1B by rotating the rotary drive shafts 51, 52 of a small roll winding device. As a result, as shown in FIG. 1C, the thermal transfer sheet or image receiving sheet 10 is wound around the feeding bobbin 1. The feeding bobbin 1 with the sheet 10 wound thereonto is mounted in a thermal transfer printer for thermal transfer recording.

At the time of winding of the thermal transfer sheet or image receiving sheet 10 around the winding shaft 4, the flanges 21, 22 function as an edge guide. Therefore, when the distance $b_1$ between the flange 21 and the flange 22 is substantially equal to the width $d_1$ of the thermal transfer sheet or image receiving sheet 10, the thermal transfer sheet or image receiving sheet 10 can be normally wound around the winding shaft 4 without causing meandering or wrinkles of the thermal transfer sheet or image receiving sheet. The relationship between the distance $b_1$ between the flange 21 and the flange 22 and the width $d_1$ of the thermal transfer sheet or image receiving sheet 10 is represented by $b_1 \geqq d_1$, and the difference between $b_1$ and $d_1$ is within about 2 mm.

Figure 1D:
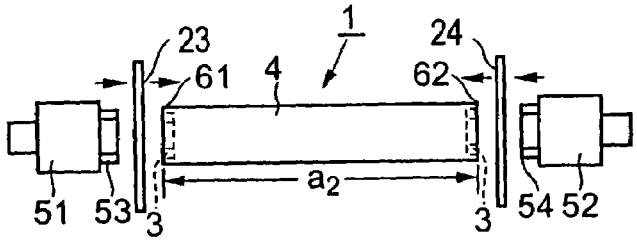
FIG. 1D is a schematic diagram of another embodiment of the feeding bobbin according to the present invention.

FIG. 1D shows a bobbin winding shaft 4 having a length of $a_2$, ring-shaped flanges 23, 24, and rotary drive shafts 51, 52 which are in a state before coupling to one another. On the other hand, FIG. 1E shows the bobbin winding shaft 4, the ring-shaped flanges 23, 24, and the rotary drive shafts 51, 52 all of which have been integrally connected to one another.

At the time of coupling of the individual members to one another from the state shown in FIG. 1D, the flange 23 and the rotary drive shaft 51 are moved in a direction indicated by a right arrow in the drawing, and the flange 24 and the rotary drive shaft 52 are moved in a direction indicated by a left arrow in the drawing. One end 61 of the winding shaft 4 is inserted into a hollow part of the flange 23, and the other end 62 of the winding shaft 4 is inserted into a hollow part of the flange 24. Further, a contact part 53 of the rotary drive shaft 51 is inserted into a bearing part 3 of one end 61 of the winding shaft 4 through the flange 23, and a contact part 54 of the rotary drive shaft 52 is inserted into a bearing part 3 of the other end 62 of the winding shaft 4 through the flange 24. Thus, as shown in FIG. 1E, all of the bobbin winding shaft 4, the ring-shaped flanges 23, 24, and the rotary drive shafts 51, 52 are coupled to one another. In FIG. 1E, the flanges 23, 24 are coupled to the bobbin winding shaft 4 in a distance $c_2$ between the rotary drive shaft 51 and the rotary drive shaft 52. The distance represented by $b_2$ is the distance between the flange 23 and the flange 24.

Figure 1E:
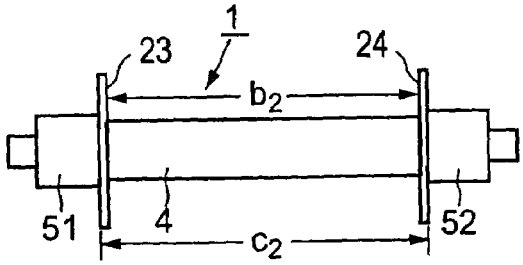
FIG. 1E is a schematic diagram of another embodiment of the feeding bobbin according to the present invention.
Figure 1F:
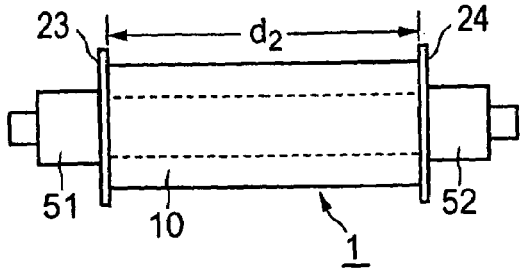
FIG. 1F is a schematic diagram of another embodiment of the feeding bobbin according to the present invention.

Next, a thermal transfer sheet or image receiving sheet 10 having a width of $d_2$ is wound around the winding shaft 4 of the feeding bobbin 1 in the state shown in FIG. 1E by rotating the rotary drive shafts 51, 52 of a small roll winding device. As a result, as shown in FIG. 1F, the thermal transfer sheet or image receiving sheet 10 is wound around the feeding bobbin 1. The feeding bobbin 1 with the sheet 10 wound thereonto is mounted in a thermal transfer printer for thermal transfer recording.

At the time of winding of the thermal transfer sheet or image receiving sheet 10 around the winding shaft 4, the flanges 23, 24 function as an edge guide. Therefore, when the distance $b_2$ between the flange 23 and the flange 24 is substantially equal to the width $d_2$ of the thermal transfer sheet or image receiving sheet 10, the thermal transfer sheet or image receiving sheet 10 can be normally wound around the winding shaft 4 without causing meandering or wrinkles of the thermal transfer sheet or image receiving sheet. The relationship between the distance $b_2$ between the flange 23 and the flange 24 and the width $d_2$ of the thermal transfer sheet or image receiving sheet 10 is represented by $b_2 \geqq d_2$, and the difference between $b_2$ and $d_2$ is within about 2 mm.

The winding shaft 4 is common to the feeding bobbin shown in FIGS. 1A to 1C and the feeding bobbin shown in FIGS. 1D to 1F, and $a_1$ is equal to $a_2$. The relationship between the width $d_1$ of the thermal transfer sheet or image receiving sheet 10 used in the feeding bobbin shown in FIGS. 1A to 1C and the width $d_2$ of the thermal transfer sheet or image receiving sheet 10 used in the feeding bobbin shown in FIGS. 1D to 1F is represented by $d_1 < d_2$. When the width of a sheet to be wound next around the common winding shaft 4 is different from the width of a sheet previously wound around the common winding shaft 4, as shown in the drawings, flanges are replaced with those having a different shape. For example, the flanges 23, 24 shown in FIG. 1A are replaced with the flanges 23, 24 shown in FIG. 1D. Further, the distance $c_1$ between the rotary drive shaft 51 and the rotary drive shaft 52 in the small roll winding device or the thermal transfer printer is made equal to the distance $c_2$ between the rotary drive shaft 51 and the rotary drive shaft 52, that is, mechanical winding conditions in the feeding bobbin shown in FIG. 1E are made identical to those in the feeding bobbin shown in FIG. 1B. When the sheet having a different width is wound under these conditions around the common winding shaft 4, the sheet can be accurately wound around the common winding shaft 4.

In the embodiment of the feeding bobbin shown in FIGS. 1A to 1C and the embodiment of the feeding bobbin shown in FIGS. 1D to 1F, after mounting the flanges 21, 22 on the bobbin winding shaft 4, the thermal transfer sheet or image receiving sheet is wound around the bobbin winding shaft 4. The present invention, however, is not limited to these embodiments only. For example, the thermal transfer sheet or image receiving sheet may be first wound around the bobbin winding shaft 4 without mounting the flanges 21, 22 on the bobbin winding shaft 4 followed by mounting of the flanges 21, 22 on the bobbin winding shaft 4. In this case, since the thermal transfer sheet or image receiving sheet 10 is wound without the use of the flanges 21, 22, the thermal transfer sheet or image receiving sheet 10 can be wound around the bobbin winding shaft 4 while slitting. This is very advantageous from the viewpoint of improving the production efficiency. Specifically, in case of the bobbin winding shaft with the flanges, the flanges are protruded from the outer diameter of the bobbin winding shaft. Therefore, when the thermal transfer sheet or image receiving sheet 10 is wound around the winding shaft 4 in such a state that the bobbin winding shaft with the flanges is mounted in a machine, the winding of the thermal transfer sheet or image receiving sheet should be carried out around the position sandwiched between the flanges using a special device, for example, a device provided with a touch roll corresponding to the sheet width. On the other hand, when the sheet is wound around the flange-free bobbin winding shaft, the winding can be carried out using a general-purpose device without using the above special device.

In both the case where the flanges are mounted before the thermal transfer sheet or image receiving sheet is wound around the bobbin winding shaft and the case where the flanges are mounted after the thermal transfer sheet or image receiving sheet is wound around the bobbin winding shaft, the bobbin with the sheet wound thereonto has flanges respectively at its both ends. Therefore, it is possible to prevent the wound sheet from being brought to an offset state even upon exposure to an impact, for example, by the fall of the bobbin.

FIGS. 2A and 2B are schematic diagrams illustrating coupling of a winding shaft to a cap-shaped flange and coupling of the cap-shaped flange to a rotary drive shaft in a feeding bobbin which is an embodiment of the present invention.

In FIG. 2A, a flange 25 is in a cap form and has a coupling part 8, and a bobbin winding shaft 4 is in a hollow form and has a notch 7. The cap-shaped flange 25 is coupled to the bobbin winding shaft 4 by inserting the coupling part 8 in the flange 25 into the notch 7 in the winding shaft 4 to bring an end face 11 of the winding shaft 4 into contact with a wall 9 of the flange 25. The wall 9 and the coupling part 8 function as a stopper. By virtue of the function of the wall 9 and the coupling part 8, after the coupling of the bobbin winding shaft 4 to the flange 25, the bobbin winding shaft 4 and the flange 25 can perform the same rotation without causing idling or slippage. Further, the flange 25 in its end face 12 is brought into contact with a rotary drive shaft 5 in its side face 13 by inserting the rotary drive shaft 5 in its contact part 53 (54) into the flange 25 in its bearing part 3. This results in the coupling of the flange 25 to the rotary drive shaft 5 and can realize the same rotation in the flange 25 and the rotary drive shaft 5 without causing idling or slippage. The bearing part 3 is extended through the center of the flange 25 from one end of the flange 25 to the other end of the flange 25.

In FIG. 2B, a flange 2 has a relatively small thickness and has a coupling part 8, and a bobbin winding shaft 4 is in a hollow form and has a notch 7. The flange 26 is coupled to the bobbin winding shaft 4 by inserting the coupling part 8 in the flange 26 into the notch 7 in the winding shaft 4 to bring an end face 11 of the winding shaft 4 into contact with a wall 91 of the flange 26. The wall 91 and the coupling part 8 function as a stopper. By virtue of the function of the wall 91 and the coupling part 8, after the coupling of the bobbin winding shaft 4 to the flange 26, the bobbin winding shaft 4 and the flange 26 can perform the same rotation without causing idling or slippage. Further, the flange 26 in its end face 12 is brought into contact with a rotary drive shaft 5 in its side face 13 by inserting the rotary drive shaft 5 in its contact part 53 (54) into the flange 26 in its bearing part 3 (a star-shaped hollow part which is located at the center portion of the flange 26 and is extended from one end (shown in the drawing) of the flange 26 to the other end (not shown) of the flange 26). This results in the coupling of the flange 26 to the rotary drive shaft 5 and can realize the same rotation in the flange 26 and the rotary drive shaft 5 without causing idling or slippage.

In the embodiment of the coupling shown in FIG. 2A, the winding shaft 4 is inserted into the cap 14 of the flange 25. Therefore, a thermal transfer sheet or image receiving sheet having a relatively small width can be wound around the bobbin. On the other hand, in the embodiment of the coupling shown in FIG. 2B, the winding shaft 4 is inserted into the flange to an extent which is shorter than the thickness e of the flange 26. Therefore, a thermal transfer sheet or image receiving sheet having a relatively large width can be wound around the winding shaft 4.

The bobbin winding shaft 4 and the rotary drive shaft 5 are common to the embodiment shown in FIG. 2A and the embodiment shown in FIG. 2B. In these embodiments, thermal transfer sheets or image receiving sheets different from each other in width can be properly wound around the common winding shaft using an identical small roll winding device or the like. In this case, the flanges 25, 26, mounted respectively on both ends of the winding shaft 4, used for the previous winding are removed, and, instead, flanges, which are in a form compatible with various thermal transfer printers or small roll winding devices, that is, are identical to the previously used flanges in end face form, and are different from the previously used flanges in length, are mounted respectively on both ends of the common winding shaft 4. The use of this bobbin enables the thermal transfer sheet or image receiving sheet with different width to be properly wound around the common winding shaft using an identical small roll winding device or the like.

In the embodiments of the coupling shown in FIGS. 2A and 2B, all of the bobbin winding shaft 4, the flange 25, 26, and the rotary drive shaft 5 are provided separately from one another and are coupled to one another. Alternatively, a member composed of a flanges 25, 26 and a rotary drive shaft 5 originally integrated with each other may be mounted on the bobbin winding shaft 4.

The feeding bobbin according to the present invention is not limited to the embodiments of the coupling shown in FIGS. 2A and 2B. For example, a construction may be adopted wherein, in members to be used in combination, one of the members is in a convex form (a male form) while the other member is in a concave form which corresponds to the convex form and surely engages with the convex form and does not cause idling or slippage. Further, in the combination of the bobbin winding shaft with the flange and the combination of the flange with the rotary drive shaft shown in the drawing, a construction may be adopted wherein the concave form is changed to the convex form while the convex form is changed to the concave form.

Figure 6:
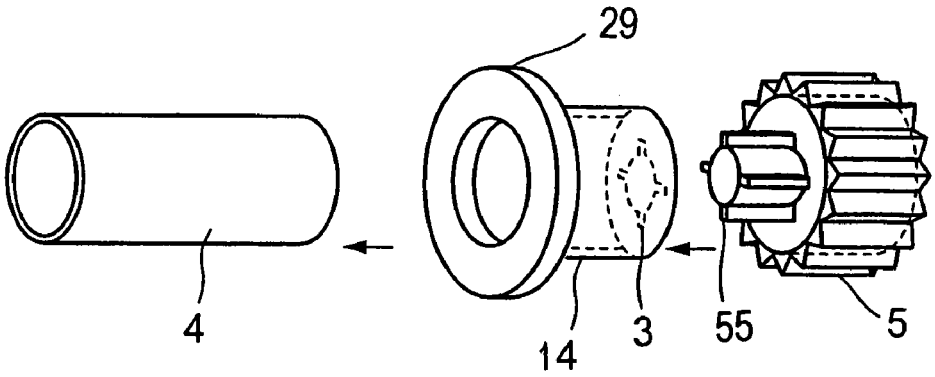
FIG. 6 is a schematic diagram illustrating coupling among a winding shaft, a flange, and a rotary drive shaft in a feeding bobbin according to another embodiment of the present invention.

FIG. 6 is a schematic diagram illustrating the coupling of a winding shaft, a flange, and a rotary drive shaft in a feeding bobbin according to another embodiment of the present invention. A bobbin winding shaft 4 having a hollow part is inserted into a flange 29 in a cap form 14. The cap 14 includes a bearing part 3. A contact part 55 of a rotary drive shaft 5 from a small roll winding device side or a thermal transfer printer side is inserted into the bearing part 3 of the flange 2 to bring the contact part 55 into contact with the inner wall of the bobbin winding shaft 4 (outer wall of the hollow part in the bobbin) to couple the bobbin winding shaft 4 to the rotary drive shaft 5. The fixation of the bobbin winding shaft 4 to the rotary drive shaft 5 can realize the same rotation in both the bobbin winding shaft 4 and the rotary drive shaft 5 without causing idling or slippage.

In a preferred embodiment of the present invention, the structure of the winding shaft is such that a metallic shaft has been covered with a heat shrinkable plastic and, upon heating of the winding shaft after the use of the thermal transfer sheet or image receiving sheet wound around the winding shaft, the metallic shaft can be separated from the heat shrinkable plastic. According to this construction, in winding the thermal transfer sheet or image receiving sheet around the surface of the winding shaft of the feeding bobbin, the winding shaft per se is less likely to be damaged because the surface of the winding shaft is covered with the heat shrinkable plastic. That is, the durability of the bobbin is so high that the feeding bobbin can be advantageously recycled by an increased number of times. If damage to the heat shrinkable plastic is found after the use of the feeding bobbin, then the heat shrinkable plastic can be easily separated from the winding shaft by heating the winding shaft to deform the heat shrinkable plastic covering the winding shaft.

The winding shaft and the deformation of the heat shrinkable plastic will be diagrammatically described with reference to FIG. 3. As shown in FIG. 3*a*, a metallic winding shaft 4 and a heat shrinkable plastic bag 15 are first provided separately from each other. As shown in FIG. 3*b*, the metallic winding shaft 4 is inserted into the heat shrinkable plastic bag 15. The environment, in which the heat shrinkable plastic bag and the metallic winding shaft exist, is heated. In a practical method, the heat shrinkable plastic bag, in which the metallic winding shaft has been placed, is passed through a shrink tunnel for heating. In this case, the atmosphere of the shrink tunnel has a temperature at or above the glass transition temperature of the heat shrinkable plastic. Next, both the heat shrinkable plastic bag and the metallic winding shaft are cooled. That is, conditions for heating the heat shrinkable plastic bag and the metallic winding shaft are eliminated, and the temperature of the heat shrinkable plastic bag and the metallic winding shaft are returned to the ambient temperature before the heating. As shown in FIG. 3*c*, the heat shrinkable plastic 15 is shrunken and is brought into intimate contact with the circumferential surface of the metallic winding shaft 4.

A thermal transfer sheet or image receiving sheet 10 is wound around the heat shrinkable plastic 15 covering the circumferential surface of the winding shaft 4 to prepare a sheet wound bobbin as shown in FIG. 3*d*.

Next, the bobbin with a thermal transfer sheet or image receiving sheet wound thereonto is used in a thermal transfer printer. When the wound thermal transfer sheet or image receiving sheet has been used up, only the winding shaft 4, the circumferential surface of which has been covered with the heat shrinkable plastic 15, stays. A heated iron core 16 is inserted into the hollow part of the winding shaft 4. As a result, as shown in FIG. 3*e*, the metallic winding shaft 4 is thermally expanded in a direction indicated by the arrows. On the other hand, the heat shrinkable plastic 15 covering the circumferential surface of the winding shaft 4 remains unchanged from the once shrink deformed state to the state before the deformation and conforms to the deformation of the winding shaft 4. When the heated iron core 16 is withdrawn from within the winding shaft 4 and is allowed to stand or is cooled, as shown in FIG. 3*f*, the metallic winding shaft 4 is returned from the expanded state to the original unexpanded state. On the other hand, the heat shrinkable plastic 15 covering the circumferential surface of the winding shaft 4 remains unchanged from the state of intimate contact with the heat expanded metallic winding shaft 4 and is kept larger than the circumference of the metallic winding shaft 4.

Therefore, as shown in FIG. 3*g*, the metallic winding shaft 4 can be easily pulled out from the heat shrinkable plastic bag 15 to separate the heat shrinkable plastic bag 15 and the metallic winding shaft 4 from each other.

As shown in FIGS. 3*a* to 3*c*, for recycling, the separated metallic winding shaft 4 can be used in combination with a fresh heat shrinkable plastic bag 15.

The feeding bobbin according to the present invention comprises a winding shaft and flanges mounted detachable respectively on both ends of the winding shaft. Both the winding shaft and the flanges may be formed of conventional materials. The winding shaft and the flange may be produced, for example, by injection molding using various thermoplastic resins. When recycling is taken into consideration, however, the winding shaft and the flange are preferably produced by molding of aluminum, stainless steel, iron, copper, or titanium which is used either as such or as a composite of these materials.

Specific examples of heat shrinkable plastics usable for covering the circumferential surface of the winding shaft include vinylidene chloride resins, vinyl chloride resins, nylon, polystyrene resins, polyethylene resins, and polypropylene resins. A film formed by extrusion of the heat shrinkable plastic can be stretched uniaxially or biaxially at a temperature at or below the glass transition point or at a temperature at or below the melting point to form a non-heat-set film. The circumferential surface of the winding shaft is covered with the heat shrinkable plastic so that the winding shaft is wrapped in the heat shrinkable plastic. The assembly is then heated at about 60 to 180° C. As a result, the heat shrinkable plastic is shrunken and is brought into intimate contact with the circumference of the winding shaft. In this case, the heating time may be regulated depending upon the material and thickness of the heat shrinkable plastic. The heating time, however, is generally approximately several seconds to 20 seconds. The thickness of the heat shrinkable plastic is about 3 to 100 μm. The above-described feeding bobbin according to the present invention is not limited to the above embodiments and may be formed of other various members within the scope of the present invention.

The method for recycling a feeding bobbin according to another aspect of the present invention is a method for recycling the above feeding bobbin and comprises the steps of: winding a thermal transfer sheet or image receiving sheet around the above winding shaft to prepare a feeding bobbin; using, in a thermal transfer printer, the feeding bobbin with the thermal transfer sheet or image receiving sheet wound thereonto; heating the winding shaft portion of the used feeding bobbin, and separating the heat shrinkable plastic from the metallic shaft; and reusing the separated winding shaft and the flanges to prepare a feeding bobbin.

Figure 4:
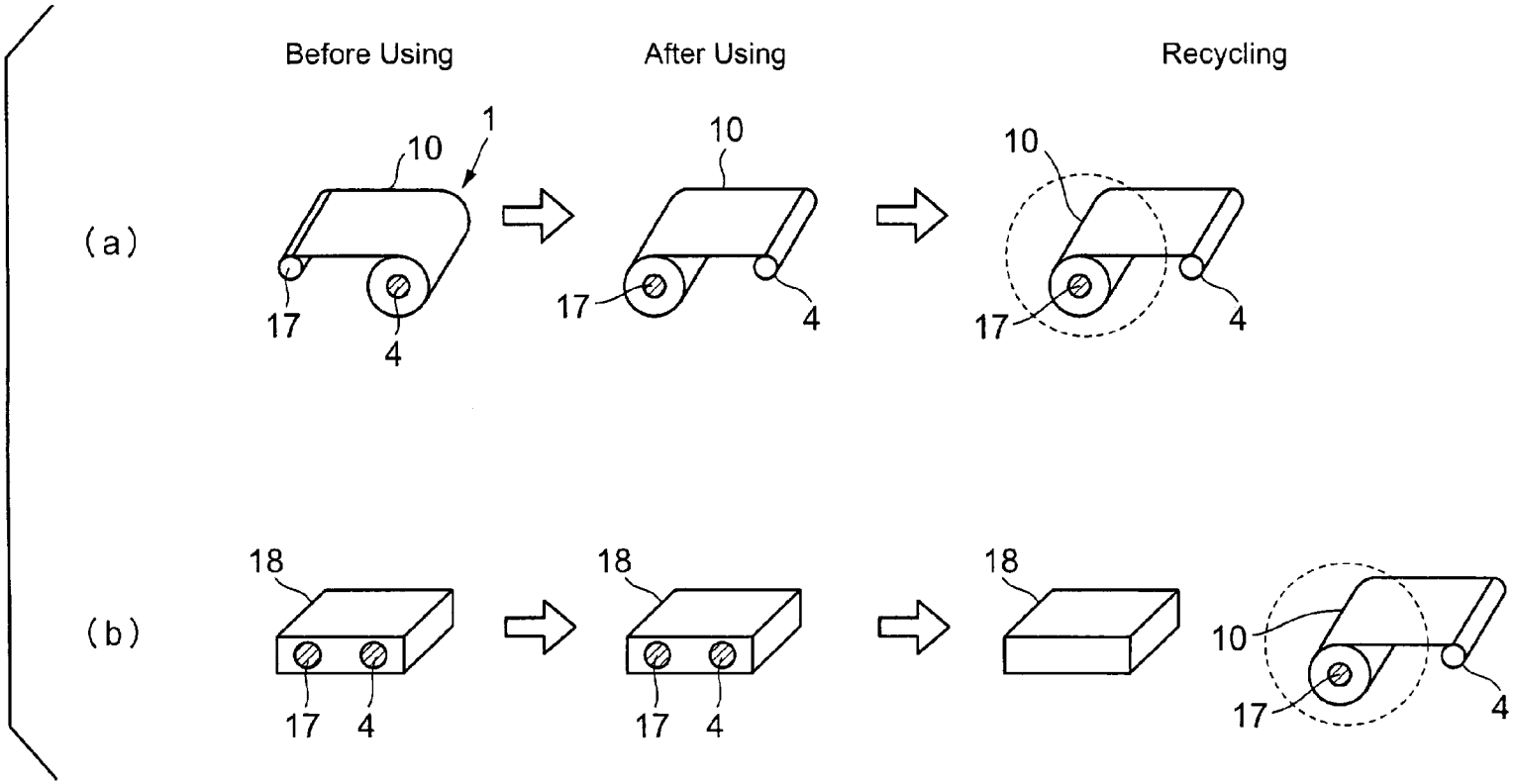
FIG. 4 is a schematic process diagram illustrating a method for recycling the feeding bobbin according to the present invention.
Figure 5:
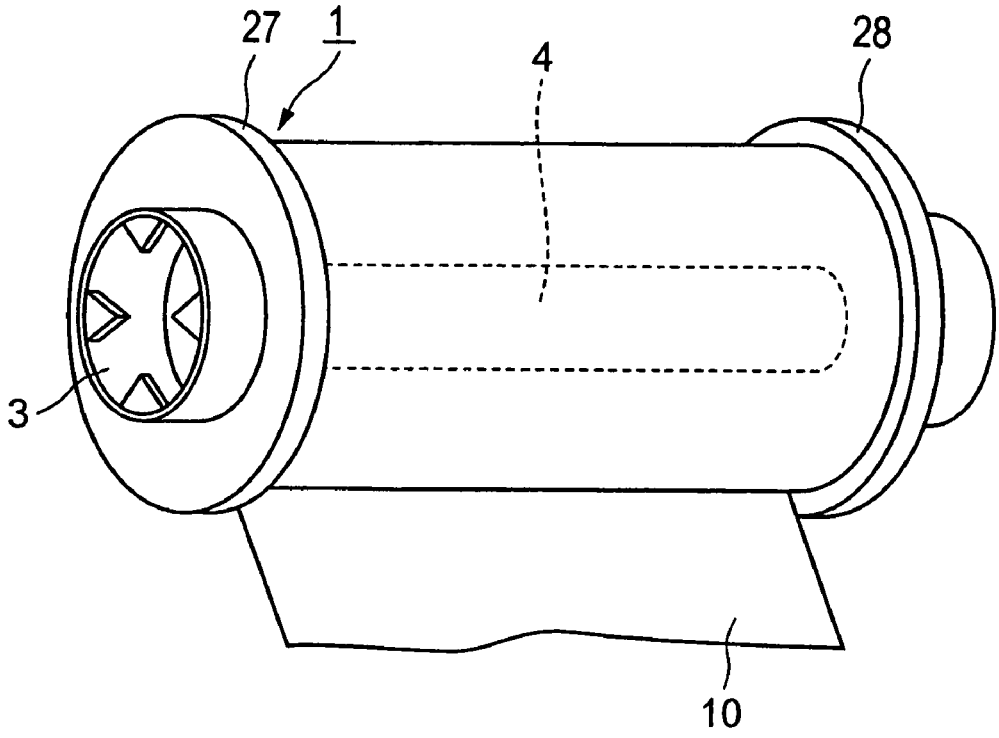
FIG. 5 PRIOR ART
FIG. 5 is a schematic diagram showing an embodiment of the state of a thermal transfer sheet wound around a conventional feeding bobbin.

In the feeding bobbin with a thermal transfer sheet or image receiving sheet wound thereonto according to the present invention, the leading end of the thermal transfer sheet or image receiving sheet is bonded to a wind-up bobbin to form a pair of small wound rolls which as such is mounted and used directly in a thermal transfer printer (FIG. 4*a*). Alternatively, a method may be adopted wherein a pair of small wound rolls are housed in a specialty cassette (cartridge) and the cassette is mounted and used in a thermal transfer printer (FIG. 4*b*). In any event, in the present invention, the feeding bobbin can be recycled.

FIGS. 4*a* and 4*b* are schematic diagrams illustrating the method for recycling the feeding bobbin according to the present invention. In the case of a small wound roll (FIG. 4*a*), even when the width of a thermal transfer sheet or image receiving sheet is different from the previously wound thermal transfer sheet or image receiving sheet, the thermal transfer sheet or image receiving sheet having the different width can be properly wound around the common winding shaft 4 in the feeding bobbin 1, and, before the use of the wound thermal transfer sheet or image receiving sheet 10 in a thermal transfer printer, the leading end of the thermal transfer sheet or image receiving sheet 10 wound around the feeding bobbin 1 is bonded to a wind-up bobbin 17.

After the use of the small wound roll in the thermal transfer printer, the wound thermal transfer sheet or image receiving sheet 10 no longer exist on the common winding shaft 4, and the thermal transfer sheet or image receiving sheet 10 is in the state of winding onto the wind-up bobbin 17 side. In the small wound roll after use, the wind-up bobbin 17 with the thermal transfer sheet or image receiving sheet 10 wound thereonto (a portion surrounded by a dotted line) is separated from the common winding shaft 4 and is discarded. The remaining common winding shaft 4 is recovered by a winding processor for the small wound roll, and the winding shaft 4 is recycled for again winding a thermal transfer sheet or image receiving sheet.

When the pair of small wound rolls are housed in a specialty cassette 18 before use (FIG. 4*b*), the procedure before and after use in a thermal transfer printer is the same as that in the case of the use of the small wound rolls without housing in the cassette. After use, the cassette 18 is dismantled. In the small wound rolls, the wind-up bobbin 17 with the used thermal transfer sheet or image receiving sheet 10 wound thereonto (a portion surrounded by a dotted line) housed in the cassette is separated from the common winding shaft 4 and is discarded. The remaining common winding shaft 4 is recovered by a winding processor for the small wound roll, and the winding shaft 4 is recycled for again winding a thermal transfer sheet or image receiving sheet.

What is claimed is:

1. A feeding bobbin for use in a thermal transfer printer, comprising:

a winding shaft having a first end and a second end;

a first flange detachable mounted on the first end; and a second flange detachable mounted on the second end; wherein:

each of the flanges comprises a first side and a second side opposite from the first side;

each of the first sides has a cap shape comprising an edge guide surface and a hollow portion for receiving the corresponding end of the winding shaft;

each of the second sides comprises a bearing part for receiving a rotary drive shaft of the thermal transfer printer;

the winding shaft comprises a portion about which a thermal transfer sheet or image receiving sheet may be wound, the portion being located between the edge guide surfaces of the flanges;

the edge guide surfaces of the flanges are separated by a sheet width corresponding to a width of the thermal transfer sheet or image receiving sheet to be wound on the winding shaft; and the sheet width can be regulated by selecting a depth of each of the hollow portions of the flanges.

2. The feeding bobbin according to claim 1, wherein:

the winding shaft comprises a metallic shaft covered with a heat shrinkable plastic covert; and the heat shrinkable plastic cover can be removed from the metallic shaft by heating the metallic shaft.

3. The feeding bobbin according to claim 2, wherein the metallic shaft comprises a metal selected from the group consisting of aluminum, stainless steel, iron, copper, titanium, and mixtures thereof.

* * * * *